US005344007A

United States Patent [19]

Nakamura et al.

[11] Patent Number: 5,344,007

[45] Date of Patent: Sep. 6, 1994

[54] RESEALABLE PACKAGE COMPRISING A CONTAINER AND WET ABSORBENT SHEET MATERIAL WITH INTERPOSED LIQUID BARRIER LAYER

[75] Inventors: Kenji Nakamura, Ashiya; Isao Kuraishi, Kyoto, both of Japan

[73] Assignee: Kennak U.S.A., Inc., New York, N.Y.

[21] Appl. No.: 83,201

[22] Filed: Jun. 25, 1993

Related U.S. Application Data

[63] Continuation of Ser. No. 749,112, Aug. 23, 1991, abandoned.

[51] Int. Cl.[5] ..... B65D 81/24; B65D 85/48; B32B 1/04; B29D 22/00

[52] U.S. Cl. ..... 206/205; 206/438; 206/449; 206/494; 206/812; 206/820; 206/823; 221/92; 221/107; 221/111; 428/68; 428/74; 428/76; 428/34.1; 428/35.2; 428/35.4

[58] Field of Search ..... 221/92, 46, 103, 107, 221/111; 206/494, 812, 820, 823, 205, 438, 449, 503, 515, 516; 428/68, 74, 76, 34.1, 35.2, 35.4

[56] References Cited

U.S. PATENT DOCUMENTS

| | | | |
|---|---|---|---|
| 3,780,908 | 12/1973 | Fitzpatrick et al. | 206/494 |
| 4,651,874 | 3/1987 | Nakamura | 206/812 |
| 4,775,582 | 10/1988 | Abba et al. | 428/288 |
| 4,790,436 | 12/1988 | Nakamura | 206/494 |
| 5,050,737 | 9/1991 | Joslyn et al. | 221/46 |

*Primary Examiner*—James D. Withers
*Attorney, Agent, or Firm*—Burgess, Ryan & Wayne

[57] ABSTRACT

The invention is a resealable package comprising a liquid and gas impermeable container with a resealable opening and a stack of wetted fibrous absorbent materials and particularly wet fibrous sheet material having interposed between the sheets of wetted absorbent materials at pre-determined intervals a liquid barrier layer. The liquid barrier layer is generally a thin flexible polymeric material which is impervious to the liquid used to wet the absorbent sheet material and is not reactable with the liquid or the absorbent sheet material.

10 Claims, 8 Drawing Sheets

RESEALABLE PACKAGE COMPRISING A CONTAINER AND WET ABSORBENT SHEET MATERIAL WITH INTERPOSED LIQUID BARRIER LAYER

This application is a continuation of application Ser. No. 749,112, filed Aug. 23, 1991 now abandoned.

BACKGROUND OF THE INVENTION

The invention relates to an arrangement of wet absorbent sheet material having interspersed layers of liquid barrier material. The invention relates to packages containing an arrangement of wet absorbent sheet material having layers of liquid barrier material interspersed among the wet absorbent sheet material. In particular, the invention relates to re-sealable packages of wet fibrous sheet material having layers of liquid barrier material interspersed between the sheets of wet fibrous material. The invention also relates to an arrangement of wetted porous sheet material having layers of liquid barrier material interspersed at predetermined intervals between the sheets of wetted porous material.

RELATED ART

Re-sealable packages of sheets of wet absorbent material are known and have become a popular article of commerce. The packages are designed to contain stacks of wet absorbent sheet material and to be re-sealable so that the package can be opened and re-sealed to permit withdrawal of individual sheets of the wet absorbent sheet material without exposing the unused sheets of wet absorbent material to drying out by contact with the atmosphere. The present invention is concerned with articles such as disclosed in U.S. Pat. No. 4,156,493, U.S. Pat. No. 4,252,238, U.S. Pat. No. 4,420,080, U.S. 4,538,396, U.S. Pat. No. 4,610,357, U.S. Pat. No. 4,651,874, U.S. Pat. No. 4,653,250, U.S. Pat. No. 4,723,301, U.S. Pat. No. 4,739,879, U.S. Pat. No. 4,790,436 and U.S. Pat. No. 4,848,475 which are incorporated herein by reference.

The known packages are particularly useful for packaging stacks of wet absorbent fibrous sheetlike material which contain predetermined amounts of a liquid composition utilized to wet the material. However, when the fibrous sheet material is wetted with a composition which must be present in each sheet of the fibrous sheet material in a pre-determined critical amount, the known re-sealable packages are generally not satisfactory. During storage, the liquid composition utilized to wet the fibrous sheet material, due to the effect of gravity, tends to preferentially migrate to the sheets of fibrous material at the bottom of a stack. That is, a sheet of the fibrous sheet material at the top of a stack of wet fibrous sheet material will contain a lower amount of the liquid wetting material than will the sheets of absorbent material at the lower part of a stack. Even though, each sheet of the fibrous sheet like material all contained the same amount of the wetting liquid when the sheets were packaged, during storage, the liquid tends to migrate to the bottom of the stack of sheets under the influence of gravity. When the amount and the composition of the liquid which is used to wet the absorbent sheet material is critical, such as when a medicament comprises the liquid with which the sheet material is wetted, the known packages cannot be utilized.

BRIEF DESCRIPTION OF THE INVENTION

According to the present invention, the problem of migration of liquid through a stack of wetted absorbent sheet material and particularly wetted fibrous sheet material can be controlled by periodically interspersing a liquid barrier material between the sheets of wet absorbent material. Particularly, the present invention comprises a plurality of wet sheets of fibrous material having interspersed at intervals, sheets of a liquid barrier material. The present invention also comprises resealable packages of stacks of a plurality of wetted sheets of absorbent material and preferably wetted sheets of a fibrous material having intermittently inserted between the wetted sheets of fibrous material a layer of a liquid barrier material.

DETAILED DESCRIPTION OF THE INVENTION

Figure 1:
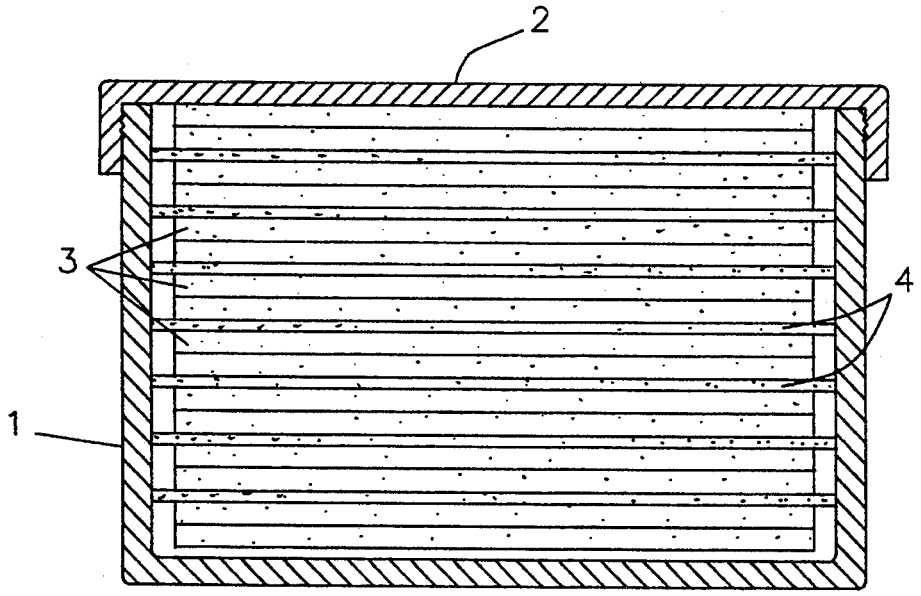
FIG. 1 is a cross-sectional representation of a jar like container containing a stack of wet fibrous sheet material having a liquid barrier layer between each two wetted sheets of absorbent material.

Stacks of liquid wetted sheets of absorbent material are known. Generally, liquid wetted sheets of fibrous material are sold in re-sealable liquid and gas impermeable containers. The containers can maintain the liquid wetted sheets of fibrous material in a wetted condition over long periods of time. The wetted sheets of fibrous material generally remain useful over long periods of time.

However, a difficulty arises when the wetted sheets of fibrous material must each contain a required amount of the liquid with which the fibrous material is wetted. It is known that if a stack of wetted sheets of fibrous material is stored for extended an period, the liquid with which the sheets of fibrous material are wetted, tends to migrate to the bottom of the stack under the influence of gravity. The surface tension and the capillary attraction of the liquid to the fibrous material are not sufficient to maintain the liquid evenly distributed throughout the stack of sheets of fibrous sheet material. The description in relation to fibrous wetted sheet material also applies to sheets of absorbent porous material and are included in the description under the term wetted fibrous material or wetted absorbent sheet material.

Generally, the variations in the amount of liquid associated with each sheet of absorbent material in a stack is not critical. The amount of liquid retained in each sheet permits wetted sheets of absorbent material to be useful. However, when the liquid with which the sheets of fibrous material are wetted contains an active material such as a medicament, it is critical that each wetted sheet of fibrous material contain a pre-determined amount of the active material. In some circumstances, it is necessary to control the amount of the active material contained in each sheet of the wetted fibrous material within a narrow range. In general, the known packages of wetted fibrous sheet materials were not suitable to maintain the amount of the liquid within the ranges required.

Solutions tend to concentrate in the wet absorbent sheet material at the bottom of a stack of sheets of wet absorbent material. However, if the wetting liquid comprises a suspension of two liquids with different specific gravities, the heavier liquid in the suspension tends to migrate to the bottom of the stack of wet absorbent sheets and the material with the lower specific gravity tends to concentrate on the sheets of wet absorbent material at the top of the stack.

Applicants have discovered that if sheets of a liquid barrier material are interspersed or interleaved between the wet sheets of absorbent material, the amount of the wetting liquid in the wet sheets of absorbent material can be controlled and the migration of the liquid under the influence of gravity can be reduced. The sheets of liquid barrier material do not have to be placed between each sheet in a stack but can be placed between every second, third, fourth sheet or at intervals which are sufficient to control migration of the liquid.

The absorbent sheet material can be any form of sheet material which can absorb and hold a liquid. However, fibrous sheet material is preferred. The fibrous sheet material can be in the form of a sheet made from a natural or synthetic fiber such as tissue, gause, paper, woven or knitted fabrics, non-woven fabrics and the like. The fiber can be a natural fiber such as wood fiber, plant fiber such as cotton, linen and the like or a synthetic fiber which is wetted by the liquid. The type of fiber which is useful to form the sheet material is dependent upon the liquid with which the sheet material is to be wetted. Generally, the fiber should not react with the liquid and should not be degraded to the point that the wetted sheets of the fibrous material stick together or become a homogenous mass. In general, the non-polar synthetic organic fibers are generally wetted by non-polar liquids and can be useful for forming the fibrous sheet material which is to be wetted by a non-polar liquid. However, fibrous materials such as paper, cotton, flax fiber and the like are generally wetted by both polar and non-polar liquids. Therefore, due to their ready availability and low cost, natural fibers such as wood and plant fibers are preferred for use in the present invention. In particular, knitted, woven and non-woven materials prepared from wood or plant fibers are preferred for use in the present invention. Particularly preferred are fibrous non-woven sheet materials. The invention is also useful for controlling migration in wetted stacks of porous or sponge like materials.

The liquid barrier material comprises a layer of a material which is resistant to penetration by the liquid with which the absorbent sheet material is wetted. The layer can be rigid, semirigid or flexible. However, a thin flexible layer of liquid barrier material has been found to be particular useful since it can be easily placed in a container with the stack of sheets of wetted fibrous material and can be easily removed from the container through a small opening. The liquid barrier material can be a rigid sheet of a liquid penetration resistant material such as a polymeric material, treated paper or the like. The liquid barrier material can be a fine mesh of a fibrous material which is not wetted by the liquid. Preferably the liquid barrier material comprises a thin flexible sheet of a polymeric material which is resistant to penetration by the liquid. The thin flexible sheet of polymeric material need not be any thicker than that required to maintain its integrity and to resist liquid penetration.

As one skilled in the art would know, the liquid barrier material must be substantially inert to the liquid and must not substantially increase chemical or biological degradation or contamination of the wetted fibrous sheet material. Preferably the liquid barrier material comprises a thin flexible sheet of a polymeric material comprising a polyolefin, polyvinyl chloride, a polyvinylidene chloride, copolymers, mixtures of polymers and the like. Selection of an effective and useful liquid barrier material is simple and requires that the material be selected on the basis of physical and chemical properties and a test to determine its compatibility with the liquid with which the fibrous sheet material is to be wetted.

To prevent loss of the liquid with which the fibrous sheet materials are wetted, the wetted sheet materials are generally packaged and stored in re-sealable gas and liquid impermeable containers. Containers such as jars which may be glass or plastic with screw tops are useful. Rigid and semi-rigid re-sealable containers made from various polymers are useful and re-sealable flexible containers made from thin flexible films of gas and liquid impermeable material are most useful. The thin gas and liquid, impermeable, flexible films generally comprise a plurality of laminated layers of different material. Re-sealable containers containing stacks of wetted fibrous materials are well known and commercially available.

Embodiments of the invention are shown in relation to various configurations of stacked fibrous sheet material, liquid barrier material and, gas and liquid impermeable containers. However, the configurations of the stacked sheet material can be combined with the various types of containers disclosed and are considered to fall within the invention.

FIG. 1 illustrates a jar like container 1 with a circular cross-section having a screw top closure 2. The jar like container 1 can be formed from glass or a gas and liquid impervious synthetic resin material. The screw closure 2 can be formed from a polymeric material or a metal. FIG. 1 shows two sheets of wetted fibrous material 3 having interspersed between each two sheets of wetted fibrous material a sheet of a liquid barrier material 4. The liquid barrier material is a sheet of a liquid impermeable material. The sheet of liquid impermeable material 4 can be a rigid or flexible material. Preferably, the liquid barrier material comprises a thin sheet of a synthetic polymer material which is impervious to the liquid with which the fibrous sheet material is wetted. However, the liquid barrier material can be a fine mesh of a material which is not wetted by the liquid, a thin sheet of rigid polymeric material, fiber reinforced resinous material, paper which has been coated with a material which makes it impermeable to the liquid or the like. Preferably, the liquid barrier material comprises a thin film of liquid impermeable plastic. As shown in FIG. 1 the sheet of liquid barrier material preferably extends beyond the edge of the wetted fibrous sheet material.

Figure 2:
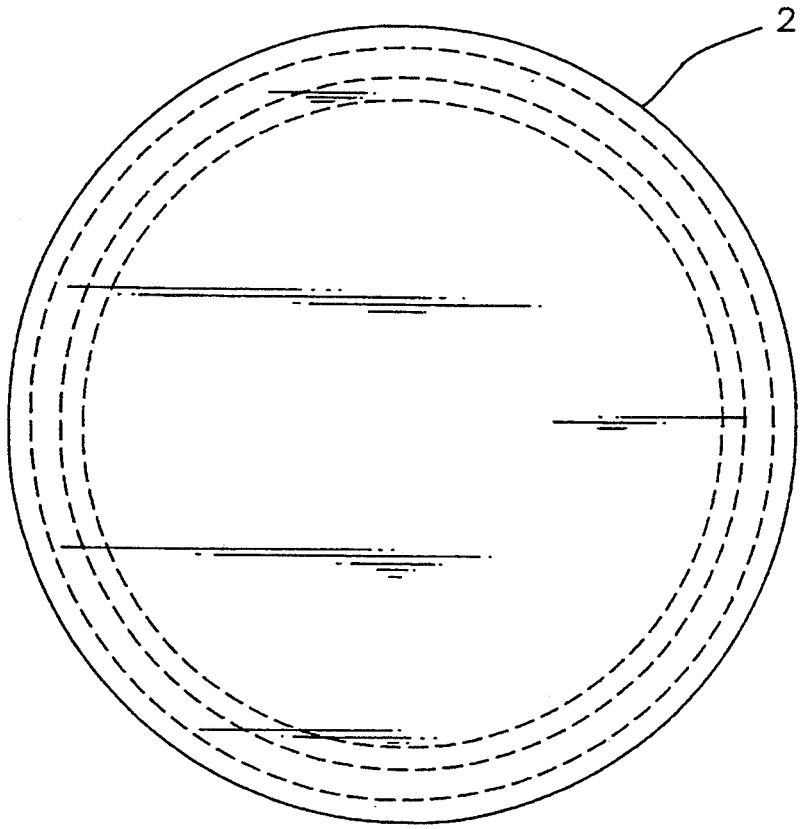
FIG. 2 is a plan view of the container of FIG. 1.

FIG. 2 is a top view of the screwcap which is used to close the jar like container and prevent evaporation and loss of liquid. The liquid barrier material does not seal, each sheet of the wetted fibrous material from each other but permits circulation of the vapor in the container to contact each of the wetted sheets of fibrous material. The liquid barrier material as shown in FIG. 1 is preferably larger than the wetted sheets of fibrous material. The stack of the wetted fibrous sheet material and the liquid barrier material can be formed by stacking two sheets of wetted fibrous material applying a layer of the liquid barrier material over the two sheets of wetted fibrous material and continuing the procedure until the desired height of the stack has been formed. As shown in FIG. 1, the liquid barrier material does not cover the top layer of the fibrous material. However, it may be desirable as a means of determining whether the container has been opened, to provide a layer of the liquid barrier material or some other material over the top of the jar-like container between the top of the container and the bottom of the screw top closure.

The stack of wetted fibrous sheet material can also be formed by stacking two layers of the fibrous sheet material, a layer of the liquid barrier material then alternating two sheets of the fibrous material and a layer of the liquid barrier material until the desired height of the stack has been formed. The stack can then be wetted by immersing the stack in the liquid for a sufficient length of time to wet the fibrous sheet material, removing the stack of wetted fibrous sheet material from the liquid and compressing the stack to remove excess or unwanted liquid. Alternatively, the sheets of fibrous material can be wetted and stacked in the wetted condition. In general, all of the embodiments of the present invention can be formed from pre-wetted fibrous sheet material or the fibrous sheet material can be wetted with the liquid after the stack has been formed. However, if the stack of fibrous sheet material with the liquid barrier material periodically dispersed between the layers is formed directly in the container, it is preferred to form the stack with pre-wetted fibrous sheet material.

Figure 3:
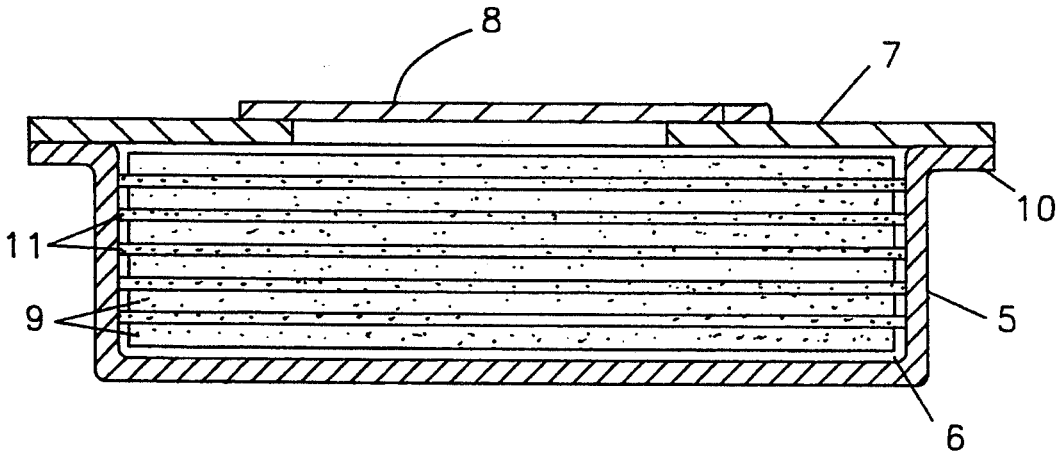
FIG. 3 is a cross-sectional representation of a rigid container containing wet fibrous sheet material with a liquid barrier material between each sheet of fibrous material.

FIG. 3 illustrates a rigid container 5 containing alternately a layer of wetted fibrous sheet material 9, and a layer of liquid barrier material 11 between each wetted sheet of fibrous material. FIG. 3 shows a rigid or semi rigid tray member 6 which can be formed by injection molding, vacuum forming or other means for forming a rigid or semi-rigid tray having thin walls. Tray member 6 contains a stack comprising wetted sheets of fibrous material 9 having dispersed between each sheet of wetted fibrous material a thin polymeric flexible film of a liquid barrier material 11. The film of liquid barrier material 11 is in the form of a thin flexible sheet which does not react with the liquid.

Figure 4:
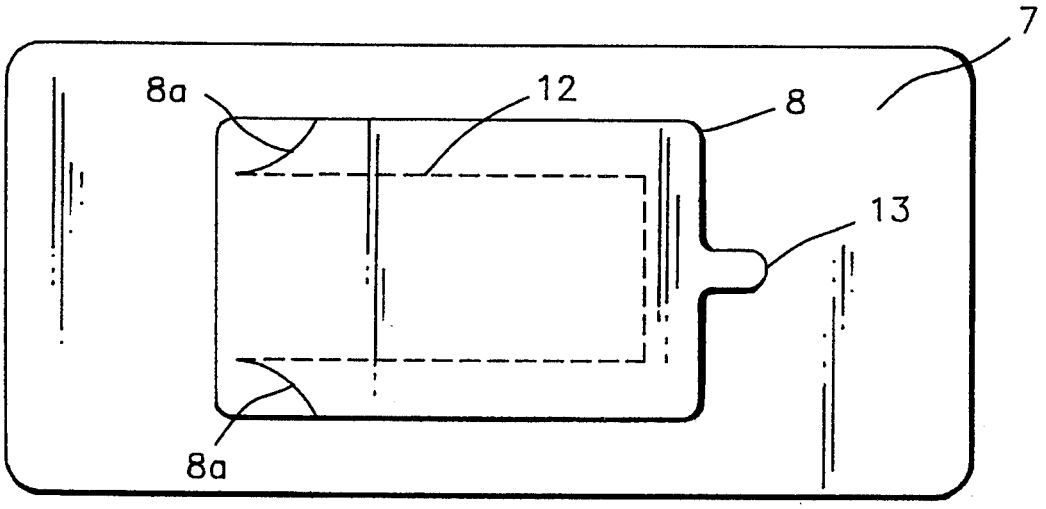
FIG. 4 is a plan view of FIG. 3.

The container 5 is sealed with a top 7 which is joined to flange member 10 to form a seal. The top 7 can be formed from a rigid, semi-rigid or flexible material which is impermeable to the vapor and liquid with which the fibrous sheet material is in contact. The top of the package 7 as shown in FIG. 4, comprises a re-sealable flap 8 which is joined to the container top 7 by a pressure sensitive adhesive material. A pressure sensitive adhesive material does not coat the tip member 13 which is not adhered to the top to enable the user to readily peel back the flap to open the package. At the end of the flap opposite to the tip member 13, the flap can be more firmly adhered to the top 7 or anchored by some other means to prevent accidental removal of the flap from the top 7. The flap can be adhered in the anchoring area in various known ways such as heat sealing, utilizing a stronger adhesive in the anchoring area, or providing slit members 8*a*.

The flap 8 is adhered to a tongue shaped section 12 which is under a portion of the flap 8. The tongue shaped portion 12 can be formed by perforating the top 7 along the outline of the tongue shape shown or by partially weakening the top 7. The perforations or the weakening of the top 7 in the area of the outline 12 of the tongue is such that the tongue portion adheres to the pressure sensitive adhesive with which the flap 8 is coated and is lifted when one grasps the tip 13 and pulls the flap 8 in an upward direction to open the container and provide access to the wetted fibrous sheet material.

In use, the top sheet of the wet fibrous sheet material is removed. When it is desired to remove the second sheet, the sheet of the liquid barrier material is removed and the next sheet of the wetted fibrous material is exposed and can be removed.

As shown in FIG. 1, the liquid barrier layer 4 is interposed between each two sheets of the wetted tissue 3. It is not necessary that the liquid barrier layer be interposed between each sheet of wetted fibrous material. Depending upon the properties of the fibrous sheets, the liquid with which it is wetted and the variation which can be tolerated in the amount of the wetting liquid retained on each fibrous sheet, it may only be necessary to interpose the liquid barrier layer between every three, four, five, six or seven sheets in the stack.

The intervals at which the liquid barrier layer must be interposed between the wetted fibrous sheets material can be easily determined by one skilled in the art. A stack of the wetted fibrous sheet material can be prepared with the liquid barrier material interposed between varying numbers of sheets in the stack. The stack of wetted fibrous material with the liquid barrier layers interposed at varying intervals is then placed in a closed container and stored for the desired storage period. After being stored, the amount of liquid or the amount of an active material retained in each fibrous sheet at the bottom and the top of the intervals between the liquid barrier layer can be determined. The intervals at which the liquid barrier layers must be interposed between the wetted sheets of fibrous materials can be determined in relation to the variation in the amount of the active material in the stack of sheets of wetted fibrous material which can be tolerated.

Figure 5:
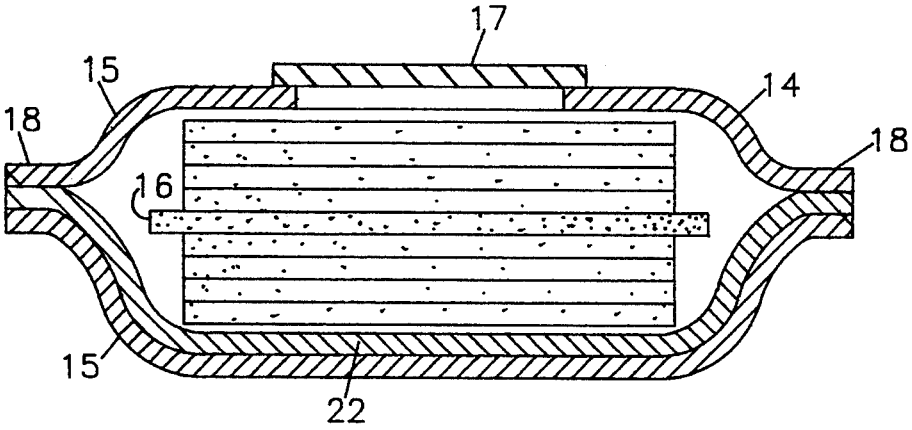
FIG. 5 is a cross-sectional view of a flexible container containing a stack of wet fibrous sheet material having a sheet of a liquid barrier material placed between every four (4) sheets of the wet fibrous material.
Figure 6:
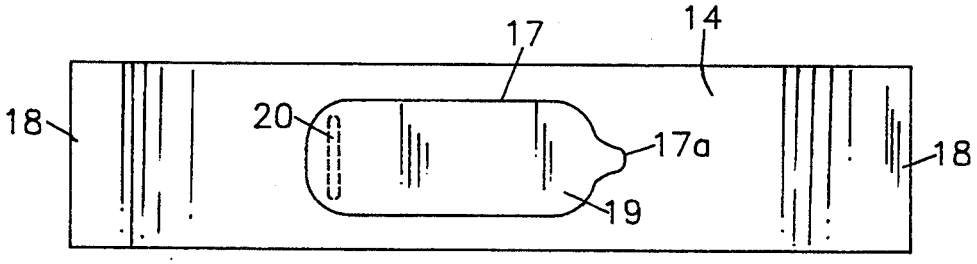
FIG. 6 is a plan view of the flexible container of FIG. 5.
Figure 7:
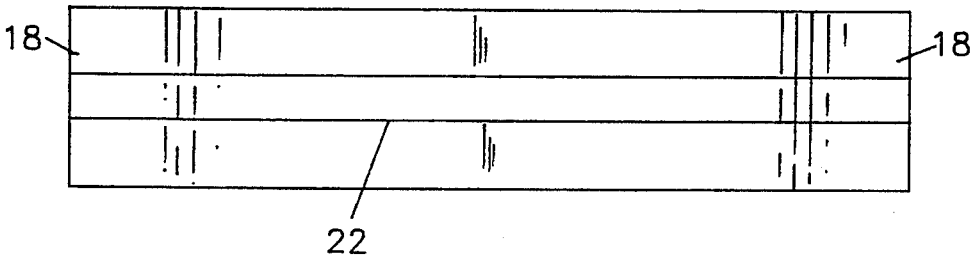
FIG. 7 is a bottom view of the flexible container of FIG. 5.

FIGS. 5, 6 and 7 illustrate a package 14 of the "pillow-pack" type formed from a single sheet of a liquid and gas impermeable flexible film. As shown in cross-section in FIG. 5, the package 14 as shown, contains a stack of eight wetted fibrous sheets 15 with a layer of liquid barrier material 16 in the middle of the stack. That is, the liquid barrier layer 16 is interposed between each four sheets of wetted fibrous material in the stack. The package shown in FIGS. 5, 6 and 7 comprises a package 14 formed from a single sheet of flexible, liquid and gas impermeable film. The package 14 has a re-sealable flap 17 adhered to the surface of the package. An elliptical opening 19 is formed by perforations in the film from which the package is made or by a line of weakness formed in the film. The flap 17 is coated with a pressure sensitive adhesive except for a tab portion 17*a*. No adhesive is applied to the tab 17*a* which provides a place to grip the flap 17 and lift it from the surface of the film. When the flap 17 is lifted, the elliptical weakened portion of the film 19 adheres to the adhesive on flap 17 and is pulled from the film. The elliptical portion 19 forms an elliptical opening in the package through which the wet fibrous sheet material can be removed. When the desired number of sheets of material have been removed from the package, the flap 18 is then pressed against the surface of the film and the pressure sensitive adhesive forms a seal on the package. Under certain conditions, it may be desirable to firmly anchor the flap 17 to the film by means of a stronger adhesive in the area 20 or by heat sealing, ultrasonic sealing or other means known in the art.

The package 14 is generally formed from a single sheet of material. The stack of wet sheets of fibrous material with the liquid barrier material interposed between the sheets at the appropriate intervals is then brought in contact with the flexible liquid and gas impermeable film. The film wrapped around the stack of wet fibrous sheets and sealed along a fin seal 22. The fin seal 22 is then laid flat against the package, the transverse seals 18 at the ends of the package 14 formed and the individual packages separated from the continuous sheet of the flexible liquid and gas impermeable material. The fin seal 22 and the end seals 18 are generally accomplished by a heating means but other means such as ultrasonic heating and adhesives can be utilized. The technology for wrapping packages is well known in the art and the details will not be discussed here.

It should be noted that the liquid barrier sheet 16 is not attached to the package 14 but is a free sheet of material and can be removed through the opening 19 after the four top sheets of wetted fibrous material have been removed. As illustrated in FIG. 5, the stack of wet fibrous sheets comprises eight sheets of wetted fibrous material with a layer of a liquid barrier material between each four sheets. A larger number of sheets can be included in the package with the liquid barrier layer material interposed after every four sheets. However, the number of sheets of wetted fibrous material in a package and the intervals at which the liquid barrier material must be interposed is determined by one forming the package which includes the size of the package to be produced and the number of wetted fibrous sheets one wishes to include in the package. Packages containing from about 6 to as many as 70 wet fibrous sheets have been manufactured.

Figure 8:
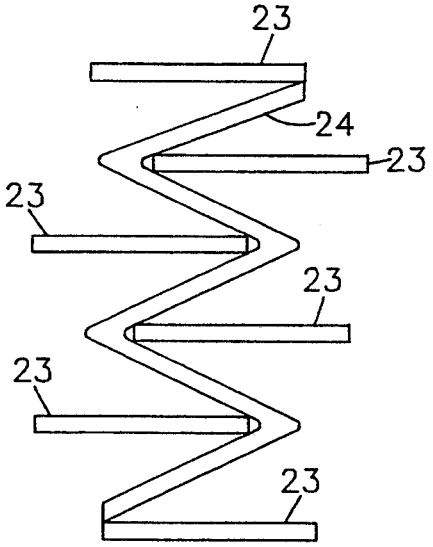
FIG. 8 is a representation of wet fibrous sheets interspersed between the folds of an accordion folded sheet of liquid barrier material.

FIG. 8 discloses an embodiment wherein a single sheet of the wetted fibrous sheet material 23 is interposed between the folds of a pleated liquid barrier layer 24. As shown, a single sheet of wetted fibrous material is enclosed between each layer of the liquid barrier material 24. However, two or more sheets of the wetted fibrous material can be interposed between each fold of the liquid barrier material. In FIG. 8, the liquid barrier material is preferably a thin flexible film of a polymeric material which is impermeable to the liquid utilized to wet the fibrous sheets 23. To aid in removal of the liquid barrier material 24 as the wet fibrous sheets are removed from a package which contains the stack, the liquid barrier material 24 can be perforated or weakened at the fold so that it can be torn off with little effort and discarded as the wet fibrous sheets are removed from the package. The weakness at the fold can be accomplished by perforations, partially cutting through the plastic film or other means known in the art.

Figure 9:
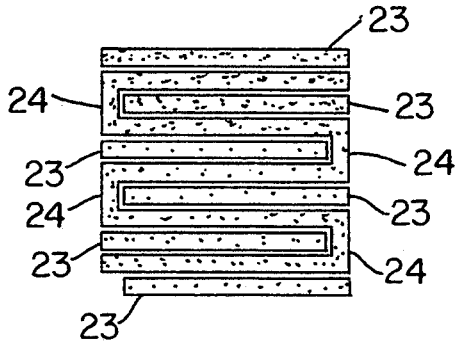
FIG. 9 is a cross-section of the stacked configuration shown in FIG. 8.

FIG. 9 shows the stack of wetted fibrous material 23 interspersed between the folds of the liquid barrier material 24 ready for insertion in a package adapted to hold the stack.

In forming the stack of the wetted fibrous material, the stack can be formed from the dry sheets of fibrous material then the fibrous material wetted with the liquid and any excess liquid removed from the stack by means such as compressing the stack or other means known in the art. The stack can be formed from sheets of pre-wetted fibrous material which are interspersed between the folds of the liquid barrier film.

Figure 10:
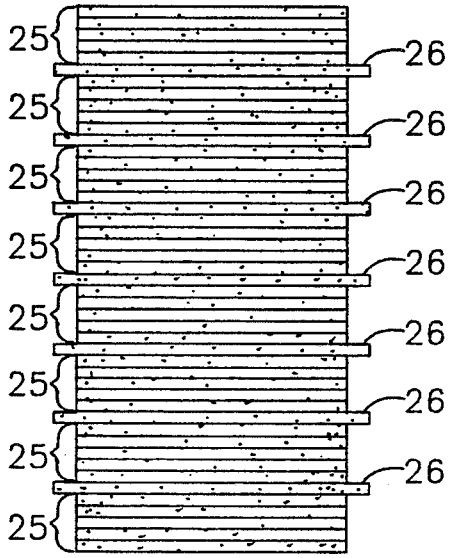
FIG. 10 is a cross-section of a stack of sheets of wet absorbent material having a sheet of a liquid barrier material between every five (5) sheets of wetted absorbent material.

FIG. 10 illustrates a stack of wetted fibrous sheets 25 having interposed after every five (5) sheets, a layer of liquid barrier material 26. The stack illustrated in FIG. 10 contains 40 sheets of wetted fibrous material. The stack can be formed by methods known in the art.

Figure 11:
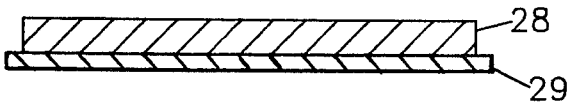
FIG. 11 is a cross-section of a sheet of wet absorbent material having a thin sheet of liquid barrier material adhered to one side.
Figure 11A:
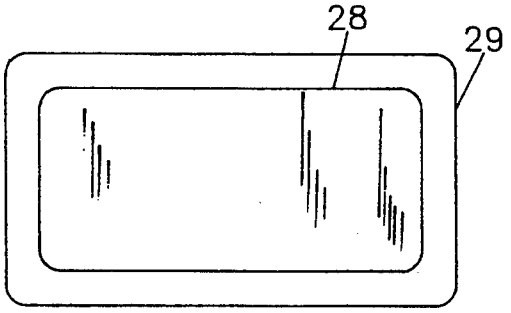
FIG. 11*a* is a plan view of FIG. 11.

FIG. 11 is an embodiment showing a wetted absorbent sheet material 28 having a thin film of liquid barrier material 29 adhered as a backing to the sheet material. This is an embodiment which may be useful at times and provides the maximum control of the amount of liquid in the wetted absorbent sheet. The film of the liquid barrier material 29 which is adhered to the sheet of material 28 is generally thin and flexible to permit the absorbent sheet to conform to any surface to which the liquid in the sheet is to be applied. The adherence of the thin flexible film 29 to the sheet of absorbent material is useful in that it limits the contact of the active ingredients which may be present in the absorbent sheet from contact with a hand which may be holding the wetted sheet. This configuration is particularly useful when the absorbent sheet comprises a porous sponge like material but is also useful with wetted fibrous sheet material. As shown in FIG. 11*a*, the thin film of liquid barrier material 29 preferably extends beyond the edge of the sheet of absorbent material 28.

Figure 12:
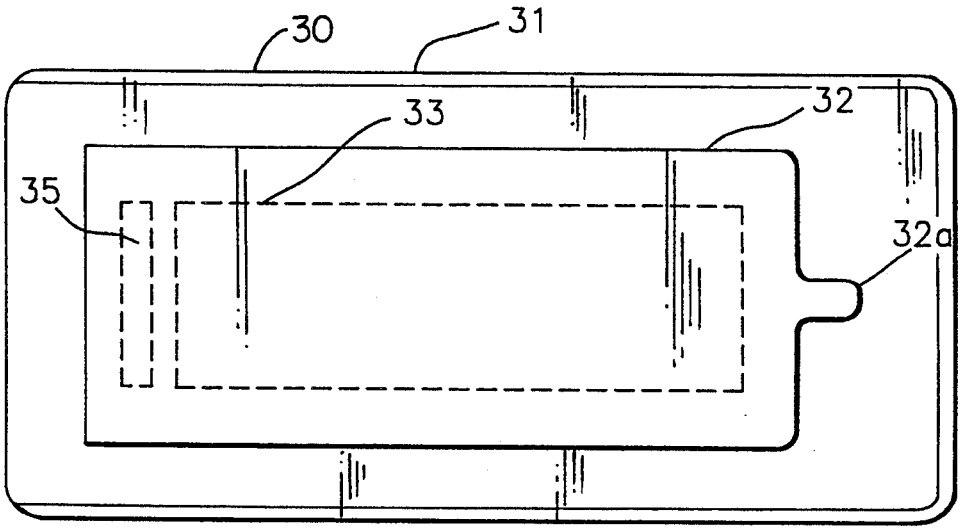
FIG. 12 is a plan view of a re-sealable flexible pouch type container for a stack of wet fibrous sheet material.

FIG. 12 is a plan view illustration of a package which is known to be useful for dispensing wetted fibrous sheet materials. The illustration is a top view of a pouch pack 30 which is formed from a single sheet of flexible liquid and gas impermeable film which is folded along edge 34 and sealed about the other three edges 31. The pouch pack 30 has a re-sealable flap 32 which is generally coated with a pressure sensitive adhesive except for projection 32*a* which is not coated with the adhesive and is utilized to provide easy access to lifting the flap 32. A perforated tongue portion or weakened line 33 is formed in the surface of the film from which the package 30 is formed. The pressure sensitive adhesive on flap 32 adheres to the tongue portion 33 outlined by the dotted line in FIG. 12 and is lifted when the tab 32*a* is pulled in a direction generally perpendicular to the face of the package 30. Lifting of the weakened section 33 provides access to the wetted fibrous sheets in the package. As shown, the end of the flap 32 is more firmly attached at the end away from tab 32*a* in an area 35. The form of attachment 35 can be achieved by any means known in the art such as a hot melt adhesive, fusing the tab to the polymer film, by an adhesive stronger then the pressure sensitive adhesive corona discharge treatment of the film in the area of the attachment or any other means known in the art. The more firmer attachment of the flap 32 at the point 35 ensures that the portion outlined by the weakened line 33 returns to close the opening left when the portion 33 was lifted from the top portion of the film from which the pouch is formed.

Figure 13:
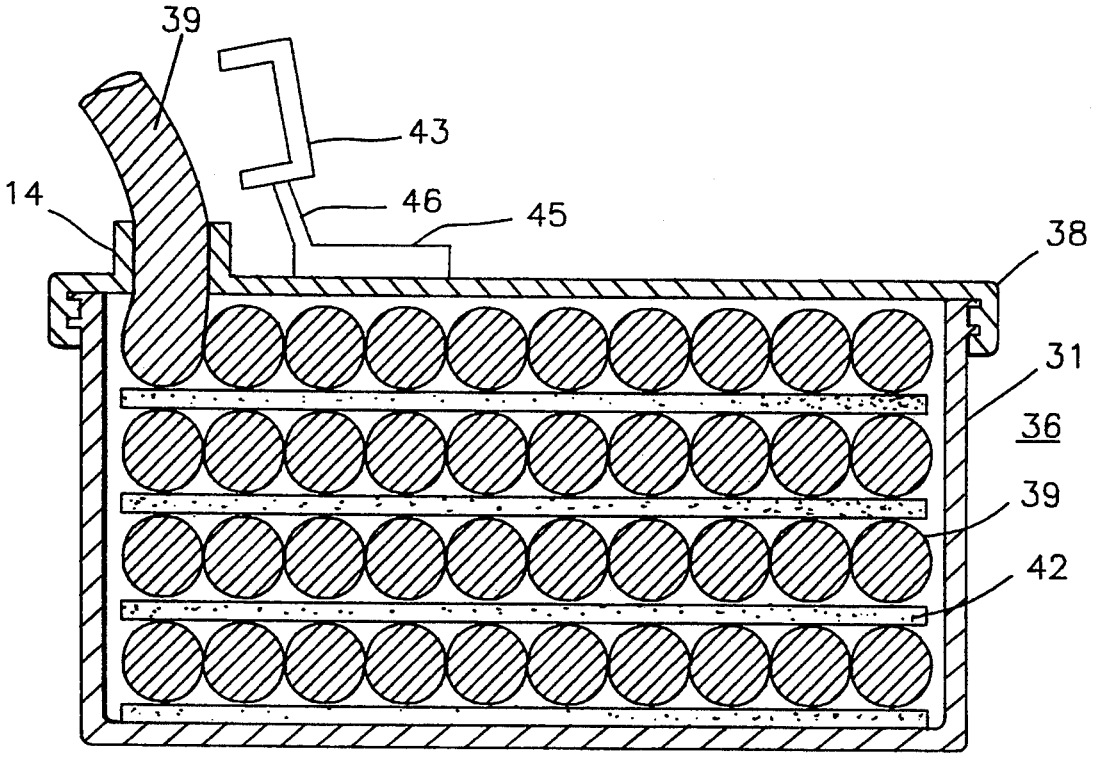
FIG. 13 is a cross-sectional representation of a rigid container with the wet fibrous sheet material gathered in a widthwise direction to form a rope, with a layer of a liquid barrier material between each layer of the fibrous sheet material in a rope-like configuration.
Figure 14:
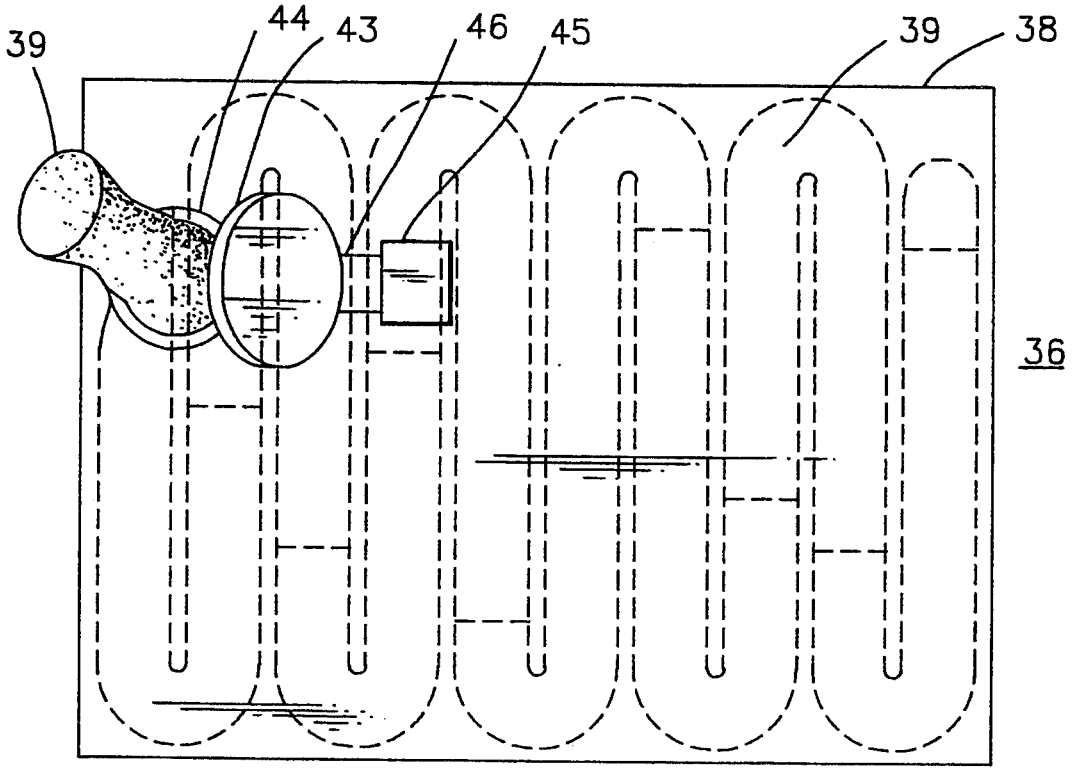
FIG. 14 is a plan view of FIG. 13 with the rope-like wet fibrous sheet material shown by dashed lines.

FIG. 13 illustrates an embodiment of the present invention wherein the wetted fibrous sheet material 39 comprises a continuous strip of fibrous sheet material perforated or weakened at predetermined intervals and gathered in a widthwise direction to form a rope-like configuration 39. As shown in FIG. 13 and FIG. 14, the container with the wetted fibrous sheet material in the rope configuration 39 comprises a container 36 having a rigid or semirigid bottom tray portion 37 and a gas and liquid impermeable top 38 which is gas and liquid tightly sealed to the bottom 37. The container top 38 has mounted thereon a cap 43 which is hingedly connected through connecting means 46 to an anchor portion 45 affixed to the top 38. The cap 43 sealingly engages a neck 44 which surrounds the opening in the top 38 through which the continuous sheet of wet tissue gathered in a widthwise direction to form the rope configuration 39 is removed from the container. The wet fibrous sheet material in the configuration of a rope 39 is perforated at pre-selected intervals to permit the sheets of fibrous material to be separated into pre-determined size sheets for use. As shown in FIG. 13 which is a cross-section of the sealed container 36, the wet tissue in the rope like configuration 39 is positioned in layers in the container 36. Between each layer of the rope-like configuration of the wet fibrous sheet material is interposed a layer 42 of liquid barrier material. As shown in the illustration of FIG. 13, the liquid barrier layer 42 is interposed between each layer of the rope like configuration 39 of the wet fibrous sheet material. However, depending upon the properties of the fibrous sheet material in relation to the liquid with which it is wetted, adequate control of liquid migration due to the influence of gravity may be achieved by interposing a layer of liquid barrier material between every two, three of more layers of the fibrous sheet material in the rope like configuration.

FIG. 14 is a plan view of the container 36 illustrating how the wetted fibrous sheet material gathered in a widthwise direction to form a rope like configuration is placed in the container 36. The positioning of the rope-like configuration of the wet fibrous tissue is shown in dotted lines in FIG. 14.

Figure 17:
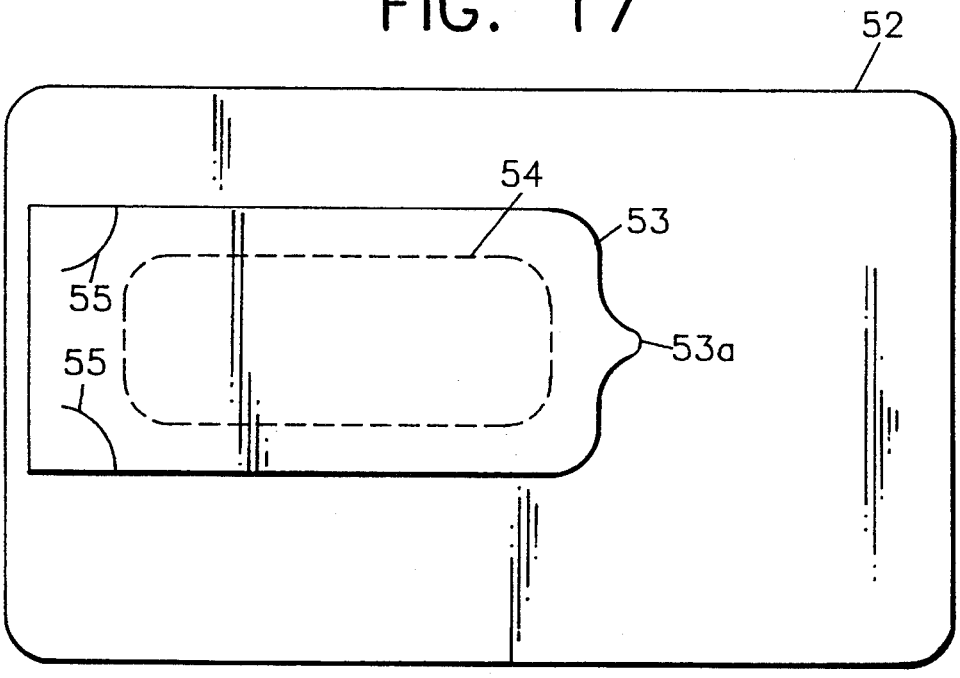
FIG. 17 is a top plan view of a container of wet fibrous sheet material in the form of a rope such as shown in FIGS. 13 and 14 with the re-sealable cap replaced by a re-sealable flap.

FIG. 17 is a plan view of an alternate embodiment of the top of the container 36 shown in FIG. 13. In FIG. 17, the cap 43 and the collar 44 are replaced by a re-sealable flap 53 and a perforated weakened portion of the cover 54. The top 52 shown in FIG. 17 is preferably made from a flexible foil material in which a weakened line which outlines the liftable portion 54 can be formed. The flap 53 is coated with a pressure sensitive adhesive which adheres the flap 53 to the top 52. The pressure sensitive adhesive also adheres the flap 53 to the outlined weakened portion 54 and lifts the weakened portion 54 from the top 52 when the flap 53 is lifted. The flap 53 has curving slits 55 near the end opposite the tab 53*a*. The curving slits 55 in the flap 53 make it difficult to remove the entire flap from contact with the top 52 should the flap 53 be inadvertently subjected to more force than is needed to unseal the container. The curving slit 55 tends to anchor the flap 53 to the top 52. The opening shown as 54 can be oriented in any direction in relation to the top of the container and can provide a larger opening for withdrawing the wetted fibrous sheet material in the configuration of a rope.

Figure 16:
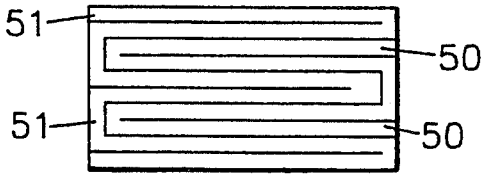
FIG. 16 illustrates a stacked arrangement of FIG. 15.

FIG. 16 is an illustration of a method of forming the fibrous sheet material 51 and the liquid barrier material 50 in a single operation. As shown, the sheet of fibrous material 51 is placed adjacent to the liquid barrier material 50.

The fibrous sheet material 51 and the liquid barrier film 50 can be perforated at the each fold line or at each second, third or fourth fold lines to provide a weakened point for easy separation of the fibrous sheet material 51 and the liquid barrier film 50 as they are removed from the package. The fibrous sheet material can be wetted before being placed adjacent to the film of the liquid barrier material and the two layers perforated along the proposed fold lines and folded to form the stack of wetted fibrous sheet material.

Figure 15:
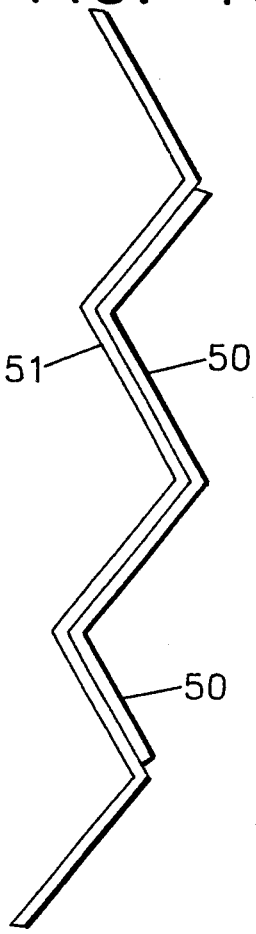
FIG. 15 is a representation of a wet fibrous sheet and a sheet of liquid barrier material accordion pleated together.

As would be known to one skilled in the art, the fibrous sheet material which is to be wetted can be folded in a widthwise direction before being placed adjacent to the film of liquid barrier material so that the sheet of wetted fibrous material can be wider than the dimensions of the liquid barrier film. The continuous strip of the superposed fibrous sheet material and the film of liquid barrier material can be of any pre-determined length so that the stack of wetted fibrous sheet material with the liquid barrier film between the layers can be of any desired height. As shown in FIG. 16, the film of liquid barrier material comprises two layers and is interposed between every two sheets of the wetted fibrous sheet material 51. As shown in FIGS. 15 and FIG. 16, the last sheets of the fibrous sheet material at the top and bottom of the stack is not adjacent to the film of liquid barrier material. Clearly, this is optional and the fibrous sheet material can be placed adjacent to the film which provides a bottom and top layer containing only one sheet of the fibrous material.

Figure 18:
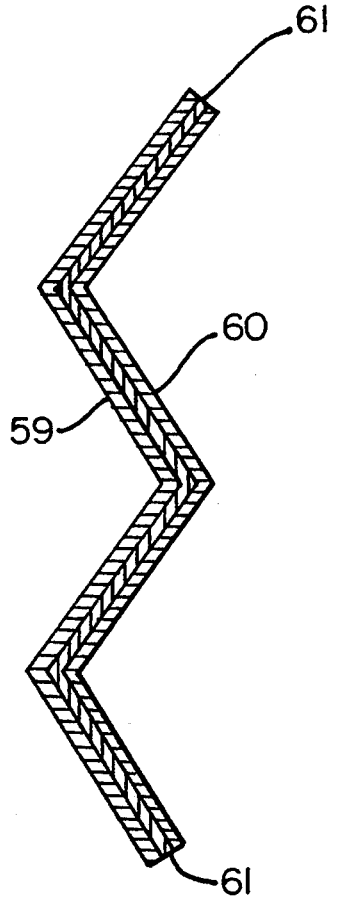
FIG. 18 is an accordian pleated arrangement of two wet fibrous sheets separated by a sheet of liquid barrier material.

FIG. 18 is an alternate embodiment of a configuration as shown in FIGS. 15 and 16. FIG. 18 illustrates sheets of liquid absorbent material 59 and 60, which are preferably fibrous absorbent material, positioned on both sides of a liquid barrier material 61. The assembly is then accordian pleated to form a stack (not shown). The stack formed differs from the stack shown in FIG. 16 in that two sheets of the absorbent material are formed between each layer of the liquid barrier material.

The sheets of liquid absorbent material can be folded parallel to the lengthwise direction to provide a sheet of absorbent material which is wider than the liquid barrier material when the sheet of absorbent material is removed from the container and unfolded.

The liquid barrier fiber and the sheet of absorbent material can be perforated transversely at intervals along its length so that the sheets of absorbent material and the liquid barrier material can be separated as the sheets of liquid absorbent material are removed from the package in which they are stored.

It would be well understood by one skilled in the art that it is possible to place two or more sheets of absorbent sheet material adjacent each side of liquid barrier material and fold the arrangement to form a stack with more than two sheets of absorbent material between each sheet of liquid barrier material. It is preferred that the sheet of liquid barrier material be at least as wide as the strip of absorbent material placed adjacent the layer of liquid barrier material in the form in which it is to be pleated. It is more preferred that the liquid barrier material be wider than the strip of liquid absorbent material.

In embodiments such as shown in FIGS. 1, 3, 5, 8 and 10, the sheets of absorbent material can be folded in a lengthwise and transverse direction to form a sheet, which when removed from the package or container, is greater in length than width than the container or package in which it is stored. The figures as shown represent a single layer of the absorbent sheet material and a plurality of layers of the sheet material by folding of the sheet material to provide a sheet of absorbent material which is greater in at least one dimension than the container or package in which they are stored.

The invention can be applied to many forms of absorbent sheet material such as absorbent porous sheet material or absorbent fibrous sheet material. Preferably the sheet material is a fibrous sheet material which is absorbent for the liquid with which it is impregnated.

Other configurations of the wet fibrous sheet material having periodically interposed a layer of the liquid barrier material other than those illustrated herein can be devised without departing from the invention. The present invention is based on the discovery that the migration of liquids in stacks of wetted absorbent sheet material can be reduced and controlled by interposing a layer of a liquid barrier material at pre-selected intervals in a stack of wetted absorbent sheet material.

The present invention can extend the usefulness of packages of pre-wetted absorbent sheet material, preferably pre-wetted fibrous sheet material, which is impregnated with suspensions or solutions of active substances which must be present in pre-determined amounts in each wetted sheet of absorbent material. Heretofore, it had not been possible to ensure that pre-determined amounts of active substances would be present in each sheet of a stack of wetted fibrous sheet material which had been stored for a time period before use. The present invention ensures that the amount of liquid and active material remains substantially uniform throughout a stack of wetted absorbent sheet material, preferably absorbent sheet material.

We claim:

1. A resealable package comprising:

a stack of wetted absorbent sheets;

a container formed by a liquid and gas impermeable material for holding said stack, said container including closure means for permitting access to said wetted absorbent sheets through an opening in said container and for resealing said opening; and at least one liquid barrier sheet interposed in said stack between a predetermined number of wet absorbent sheets, each said liquid barrier sheet being detached from said container to provide gaseous communication between opposite sides of said liquid barrier sheet and each said liquid barrier sheet having opposite sides, with one side in contact with a first wetted absorbent sheet and the opposite side in contact with a second wetted absorbent sheet.

2. A resealable package according to claim 1, wherein said liquid barrier sheet comprises a thin, flexible, liquid impervious film.

3. A resealable package according to claim 1, wherein the liquid barrier sheet comprises a fibrous material having a fine mesh which is sufficiently small to prevent the passage of liquid from said wetted absorbent sheets therethrough.

4. A resealable package according to claim 1, wherein said liquid barrier sheets are connected together along perforated fold lines and folded in an accordion pleated configuration along said perforated fold lines, with said predetermined number of wet absorbent sheets positioned between at least some adjacent folds of said liquid barrier sheet.

5. A resealable package according to claim 4, wherein each said predetermined number of wet absorbent sheets are positioned between each pair of adjacent folds of said liquid barrier sheet.

6. A resealable package according to claim 4, wherein said wet absorbent sheets are connected together along perforated fold lines and folded in an accordion pleated configuration along said perforated fold lines, and said accordion pleated configuration of wet absorbent sheets is positioned on one side of said accordion pleated configuration of liquid barrier sheets.

7. A resealable package according to claim 6, wherein there is a second accordion pleated configuration of wet absorbent sheets positioned on the opposite side of said accordion pleated configuration of liquid barrier sheets.

8. A resealable package according to claim 1, wherein each said liquid barrier sheet has a larger area than each said wet absorbent sheet.

9. A resealable package according to claim 8, wherein each said web absorbent sheet is adhered to one said liquid barrier sheet.

10. A resealable package according to claim 1, wherein said wet absorbent sheets are connected together along perforated lines to form a continuous sheet of wet absorbent sheets, and said continuous sheet is rolled to form a rope-like configuration.

* * * * *